United States Patent [19]

Kuehn et al.

[11] 4,201,206

[45] May 6, 1980

[54] HEAT RECEIVER FOR DIVERS

[75] Inventors: Lorne A. Kuehn, Downsview; Louis A. Pogorski, Toronto, both of Canada

[73] Assignee: Her Majesty the Queen in right of Canada, as represented by the Canadian Minister of National Defence, Ottawa, Canada

[21] Appl. No.: 943,491

[22] Filed: Sep. 18, 1978

[51] Int. Cl.[2] ..... A62B 7/00

[52] U.S. Cl. ..... 128/201.13; 165/DIG. 17; 165/65

[58] Field of Search ..... 128/212, 142 R, 147, 128/142.2; 165/4, 65, DIG. 17

[56] References Cited

U.S. PATENT DOCUMENTS

| | | | |
|---|---|---|---|
| 3,747,598 | 7/1973 | Cowans | 128/212 X |
| 4,090,513 | 5/1978 | Togawa | 128/212 |
| 4,136,691 | 1/1979 | Ebeling et al. | 128/212 |

*Primary Examiner*—Henry J. Recla

*Attorney, Agent, or Firm*—Hirons, Rogers & Scott

[57] ABSTRACT

A heat receiver is provided comprising a housing through which the breathing mixture passes in one direction and through which the exhaled breath passes in the opposite direction. The housing contains heat conductive elements through which the breathing mixture and exhaled breath pass and spacers positioned one between each pair of adjacent heat conductive elements. The spacers are poor heat conductors and non-hygroscopic to minimize moisture retention. In use, exhaled breath warms the heat conductive elements sequentially so that each element will be slightly cooler than the last element exposed to the exhaled breath. There will be minimal heat stored in the spacers and the moisture content of the exhaled breath tends to be carried through the device so that upon drawing breathing mixture through the device a substantial part of the sensible heat originally in the exhaled breath will be reclaimed by the breathing mixture. The latent heat originally in the exhaled breath will be lost.

4 Claims, 5 Drawing Figures

HEAT RECEIVER FOR DIVERS

This invention relates to a device for recovering heat from a diver's exhaled breath and for using this heat to pre-heat breathing mixture as it is being inhaled by the diver.

A diver loses heat both by direct convection through his diving suit and by respiration heat loss. The former losses can be controlled by properly designed insulated diving suits whereas the latter form of heat loss is more difficult to control.

Respiration heat loss results from breathing cold and dry breathing mixture which has a heat content substantially less than that of a corresponding volume of exhaled breath. This is because the exhaled breath leaves the body substantially at body temperature and has picked up moisture to the point where it is moisture saturated. The respiration heat loss can result in substantial discomfort and possible hypothermia to the diver. Also, because this heat loss represents a significant energy requirement, it can be a direct contributor to diver tiredness.

There have been two distinct approaches to solving the problem of respiration heat loss. A first is to actively pre-heat the inhaled breathing mixture and a second is to use a passive heat receiver which is heated by exhaled breath and which then permits inhaled breathing mixture to pick up some of this heat. The present invention falls into the latter category.

The requirements of passive heat receivers are many and varied. They include a requirement that the heat receiver be light and small and that it consist of a minimum of parts and preferably excludes moving parts. There should be a limited pressure drop across the heat receiver when the diver is breathing, and if possible the pressure drop should be maintained constant. If the pressure drop varies the diver may get the impression that the system is malfunctioning and in extreme cases the diver could panic with fatal results. The structure should therefore be free from clogging. Other requirements are that corrosion should be eliminated, there should be minimal maintenance, and the results should provide good efficiency for a relatively low financial expenditure.

One attempt at a passive heat receiver is illustrated in U.S. Pat. No. 3,747,598 to Kenneth W. Cowans. In this structure exhaled breath passes through a regenerative material consisting of layers of heat conductive material spaced apart about layers of hygroscopic material. This structure is typical of the general approach taken in a number of other designs where attempts are made to recover both the latent and the sensible heat from exhaled breath.

Part of the reasoning behind structures such as that shown in the Cowans patent is that it was considered inevitable that exhaled breath would create some condensation in the heat receiver. Consequently the structures were designed to permit free breathing while collecting this condensation. It will be evident that if the condensation simply covered surfaces of the heat receiver then the air passages would have to be sufficiently large to ensure that no restrictions were created which would increase the pressure drop and hamper the diver's breathing. Such large passages are inherently contrary to the design requirements for an efficient receiver where a large surface area in contact with the exhaled breath is obviously preferable. The Cowans structure overcomes this to some extent in that a hygroscopic material is used so that the moisture is absorbed in the material rather than collected on the surface. Nevertheless, there will be some collection on the surface, (particularly after prolonged use) and consequently the air passages must be designed to ensure that such a collection does not prove to be dangerous.

Unexpectedly it has now been found that an efficient heat receiver can be created for use with oxygen-nitrogen and helium-oxygen mixtures in which the sensible heat is collected and in which the latent heat collected is of small significance. Consequently the diver is not exposed to noticeable changes in pressure drop while he is breathing through the heat receiver because there is no significant moisture condensation to restrict the air passages. Heat absorbing elements in the heat receiver have a very high surface area available to exhaled breath and to breathing mixture resulting in good thermal efficiency.

To achieve the desired result, a heat receiver is used comprising a housing through which the breathing mixture passes in one direction and through which the exhaled breath passes in the opposite direction. The housing contains heat conductive elements through which the breathing mixture and exhaled breath pass and spacers positioned one between each pair of adjacent heat conductive elements. The spacers are poor heat conductors and non-hygroscopic to minimize moisture retention. In use, exhaled breath warms the heat conductive elements sequentially so that each element will be slightly cooler than the last element exposed to the exhaled breath. There will be minimal heat stored in the spacers and the moisture content of the exhaled breath tends to be carried through the device so that upon drawing breathing mixture through the device a substantial part of the sensible heat originally in the exhaled breath will be reclaimd by the breathing mixture. The latent heat originally in the exhaled breath will be lost.

The invention will be better understood with reference to the following description and drawings in which.

Figure 1:
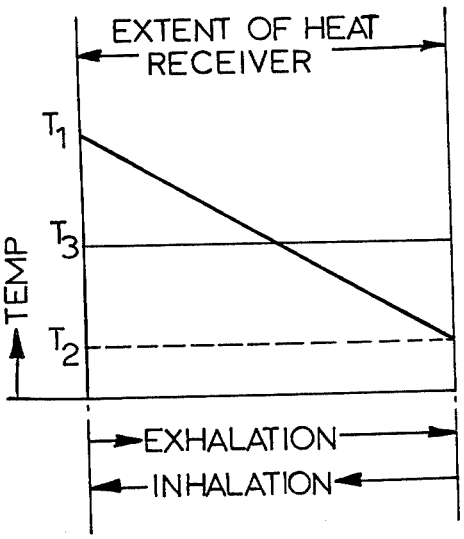
FIG. 1 is a graphical representation of a particular form of heat receiver which is not in accordance with the invention and which is included for use in the description.

For the purposes of explanation, FIG. 1 has been included to show the effect of exhaling over a heat receiver consisting of a single piece of heat conductive material having a cross-section which is constant in the direction of flow of the exhalation. Referring to FIG. 1, the exhaled breath initially impinges on the heat receiver at a temperature $T_1$ and as the breath passes over the heat receiver and sensible heat is given to the receiver, the temperature of the exhaled breath will drop to a temperature $T_2$ where the exhaled breath leaves the heat receiver. However, if the material is a good thermal conductor, before inhalation takes place the heat will tend to equalize over the heat receiver at a temperature $T_3$. Consequently, the maximum temperature that can be reached by the inhaled breath is $T_3$. It will therefore be apparent that such a simple heat receiver will never reach high efficiency no matter how much sensible heat is removed from the exhaled breath.

Figure 2:
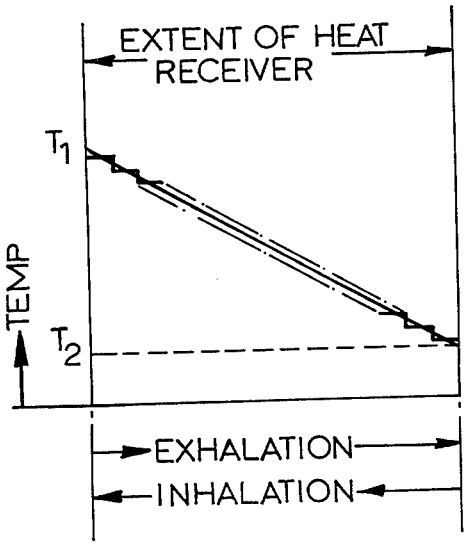
FIG. 2 is a graphical representation of the performance of a heat receiver according to the invention.

Reference is now made to FIG. 2 which illustrates graphically the effect of providing a heat receiver consisting of a series of heat conductive elements which are insulated thermally from one another and yet which are all exposed sequentially to the exhaled breath. As before in FIG. 1 the temperature drop will be from $T_1$ to $T_2$. However each individual element of the heat receiver will act like the single heat receiver of FIG. 1. Consequently in each element of the FIG. 2 heat receiver there will be an equalization of temperature so that the final graph of the heat distribution will appear as a series of discontinuous steps spaced about a line drawn between the temperatures $T_1$ and $T_2$ at opposite ends of the heat receiver. It will be evident that if the number of elements in the heat receiver approaches infinity, the steps will become infinitesimally small and the resulting graph will approach a straight line. In practice it is not practical to provide an infinite number of elements but if a large number are provided then the graph will nevertheless approximate a straight line in the manner shown in FIG. 2. Consequently during inhalation the breathing mixture is exposed sequentially to the elements over a range of temperatures from slightly greater than $T_2$ to slightly less than $T_1$. This will result in a tendency to heat the breathing mixture as efficiently as possible and certainly above the temperature $T_3$ shown in FIG. 1.

FIGS. 1 and 2 exclude latent heat. It is well known that exhaled breath is almost saturated with moisture. Consequently, as soon as the breath cools there is a tendency for condensation to take place in the heat receiver. This has been encouraged in prior art devices and it has been thought that the collection of latent heat was necessary to provide adequate pre-heating of inhaled breath consequently increasing the exchanger efficiency.

By contrast with prior art structures the present invention is designed to remove as much sensible heat as possible without condensation in the exhaled breath. It is well known that moisture condenses preferentially on roughened surfaces and the present invention includes structure which is intended to avoid such condensation. Only smooth non-hygroscopic surfaces are provided so that moisture droplets tend to be carried through the device by the exhaled breath. There is minimal moisture collected thus providing a large surface area of heat-conducting elements to remove sensible heat from the exhaled breath. This contrasts with prior art structures where the design was dictated by what was theoretically envisaged as increased exchanger efficiency by collection of latent heat contained in the moisture of the humid exhaled breath.

Figure 3:
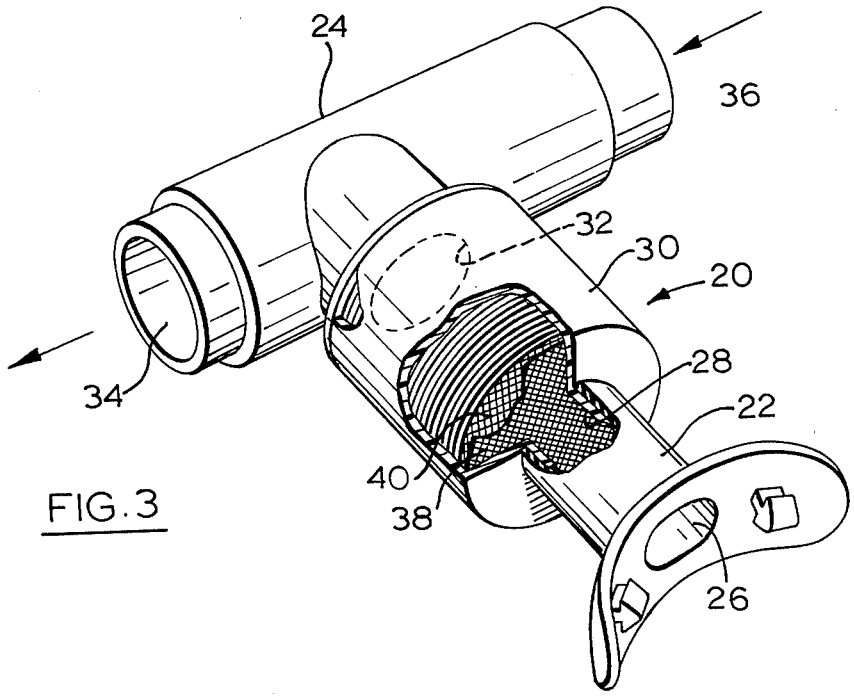
FIG. 3 is a perspective view with parts broken away and illustrating a preferred embodiment of heat receiver according to the invention, the heat receiver being shown attached to conventional parts of a breathing system used by a diver.

Reference is now made to FIG. 3 which illustrates a preferred embodiment of a heat receiver 20 coupled at a first end to a conventional mouthpiece 22 and at its other end to a T-piece 24 forming part of a conventional breathing system which is not shown to simplify drawing.

Exhaled breath passes down an opening 26 in the mouthpiece 22 and enters a first port 28 in a housing 30 forming part of the heat receiver 20. The port is cylindrical and coaxial with the cylindrical body of the housing 30 and an axial second port 32 is provided through which exhaled breath passes on its way to the T-piece 24. This breath then finds it way out of an exit 34 of the T-piece. Upon inhalation breathing mixture passes through an entrance 36 in the T-piece and due to valving which is not shown the breathing mixture can be inhaled without drawing in exhaled breath. This breathing mixture then passes through the second port 32, through the housing 30, and then by way of the first port 28 and opening 26 into the user's mouth.

The housing 30 is of a material which is substantially not heat-conductive and the housing contains a plurality of thin gauze-like heat-conductive elements 38 which are separated by non-conductive and non-hygroscopic spacers 40 so that there is very little heat conduction between adjacent elements 38.

The heat conductive elements 38 can be of any suitable material depending on the prevailing conditions. Both 30 brass mesh and 100 brass mesh provide good exchange properties. The number of elements will depend on the gas mixture and breathing resistance. Some testing may have to be done to determine the optimum number and size of discs for a given arrangement. As an indication, it was found that in the FIG. 3 arrangement for use with air or oxyhelium 500 discs were used of 100 mesh having a diameter of 4.13 cm. In general the discs should have a mass of no less than 100 gms. and a surface area in the range 6,000 to 10,000 square cms.

Suitable non-conductive spacers are made from a gauze-like moulding of teflon and the housing is of polycarbonate. Other suitable materials could be used such as nylon for the spacers and for the housing, and polyvinylchloride for the housing.

It was found with these arrangements of heat receiver that when the breathing mixture was a 20/80 oxygen/nitrogen mixture of a 20/80 oxygen/helium mixture then the device operated satisfactorily for extensive periods. A most important consideration is the fact that with these breathing mixtures the device was capable of continuous use for extended periods without significant moisture build-up particularly at low gas inlet temperatures. It was found under laboratory conditions that when moisture build-up was created deliberately by using a different device there was then a tendency for the user to suddenly panic and to remove the device from his mouth. Obviously such panic could not be tolerated in deep diving and consequently, apart from the good thermal efficiency achieved with the present structure, the safety factor is also of great importance.

Returning to FIG. 3, each of the heat conductive elements 38 exhibits a relatively high surface area to exhaled breath per unit of area. However the mass per unit of area is relatively small. As mentioned a very large number of elements could be used but it has been found preferable to take advantage of the high surface area and to compensate for the low mass by passing the exhaled breath over a central portion and dissipated over the whole area of the element. While this arrangement will tend to emphasize the steps in the graph shown in FIG. 2, it achieves two purposes. Firstly, the air is restricted to flow quite quickly over a central area of the elements thereby limiting the possibility of droplet formation in the structure, and secondly each of the elements has an adequate mass for heat retention. The structure therefore takes advantage of the flushing action of the exhaled breath while at the same time providing an adequate heat receiver where moisture build-up is substantially reduced when oxygen/nitrogen mixtures and oxygen/helium mixtures are used.

In some instances it may prove acceptable to pass exhaled breath directly over the total area of the elements. As mentioned the number of elements would have to be increased if the same material and mass is maintained for the elements. Also in such a structure the area of each element could be increased only if the rate of flow of breath over the elements continues to be adequate to carry water droplets out of the heat receiver.

Figure 4:
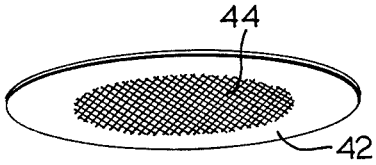
FIG. 4 is a perspective view of an alternative embodiment of heat conductive element for use in another embodiment of heat receiver according to the invention.

Reference is now made to FIG. 4 which shows another embodiment of heat conductive element such as the element 38 shown in FIG. 3. As previously described with reference to FIG. 3, the breathing mixture and exhaled breath come into contact primarily with the central portion of the element 38 (FIG. 3). The mass of the element can be increased without increasing the thickness of the element by forming a solid perimeter 42 to receiver heat conducted by the central perforated portion 44. This portion can be similar to the guaze used in element 38 (FIG. 3).

The spacers 40 (FIG. 3) could also be formed with a solid perimeter. Such spacers when used with the elements 38 would ensure a central flow path without changing the structure of elements 38 to elements such as that shown in FIG. 4.

In general, the heat conductive elements must be perforated at least in a central area where exhaled breath will pass through the element. The term "perforated" is intended to include any structure having adequate openings through the structure for passage of exhaled breath. Obviously these openings should also be defined by material which exhibits a large surface area to the exhaled breath for removal of heat and, as mentioned, a number 100 brass gauze has been found preferable. However it is entirely possible that a thin sheet of brass or equivalent material could be used and perforated to provide a heat-conductive element.

Figure 5:
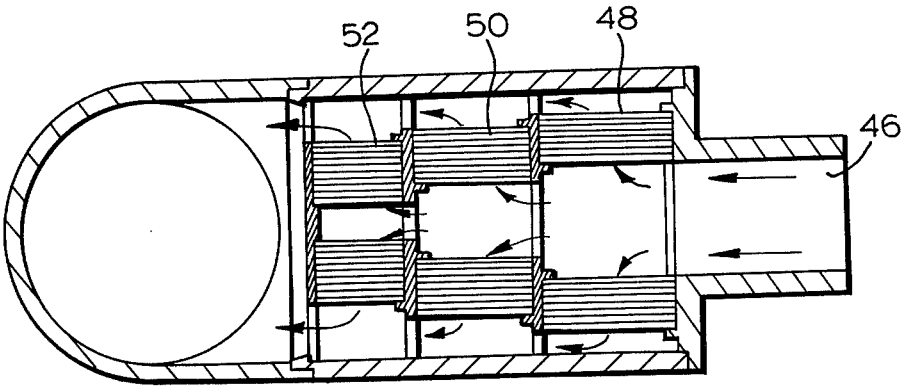
FIG. 5 shows a further embodiment of a heat receiver according to the invention.

It will be appreciated that the form of the elements and spacers can be changed consistent with providing a low pressure drop. FIG. 5 illustrates an arrangement in which the elements are cylindrical and exhaled breath enters by way of an inlet port 46 and is distributed through groups of elements and spacers 48, 50, and 52. The purpose of using such a distribution is to ensure adequate flow through each of the groups and also to limit the diameter of the largest element. It will be evident that in any group such as the group 48 the innermost element will have a smaller diameter and hence a smaller mass than the outermost element (assuming the same material is used). In order to maintain the graph shown in FIG. 2 it is desirable that each of the elements be similar and consequently in order to limit the difference between the innermost and outermost elements a series of groups 48, 50 and 52 is used.

The description has been directed to the use of oxygen/nitrogen and oxygen/helium mixtures because those mixtures are most commonly used. The devices according to the invention are capable of use in deeper dives for extended periods using such mixtures. However, the devices could be used for shallow dives with pure oxygen particularly for dives of short duration.

What we claim as our invention is:

1. A device for collecting sensible heat from a diver's exhaled breath and for exposing breathing mixture to this heat during inhalation to limit a diver's respiration heat loss, the device comprising:

a housing having poor heat-conducting qualities and adapted to be coupled to a breathing system adjacent to a portion of the system which is normally in contact with a diver's mouth, the housing having first and second ports between which breathing mixture is to pass along a flow path in one direction and between which exhaled breath will pass in the opposite direction;

a plurality of thin heat-conductive elements spaced-apart in generally parallel relationship inside the housing, these elements being arranged to lie across said flow path in series and being perforated for passage of the breathing mixture and of the exhaled breath sequentially through the elements;

a plurality of thin, relatively non-conductive and non-hygroscopic spacers sandwiched one between each adjacent pair of said heat-conductive elements, each of the spacers also being perforated whereby flow of exhaled breath will warm the heat conductive elements sequentially so that each element will be slightly cooler than the last element and there will be no direct heat conduction from one element to the next element, and whereby there will be minimal heat stored in the spacers and the moisture content of the exhaled breath will be substantially unaffected by passage through the device so that upon drawing breathing mixture through the device there will be a gradual warming of this mixture as it collects heat from the elements and a substantial part of the sensible heat originally in the exhaled breath will be reclaimed by the breathing mixture; and means adapted to couple the housing to a breathing system.

2. A device as claimed in claim 1 in which the elements are circular and disposed about a central axis, and in which the first and second ports are also disposed about this axis.

3. A device as claimed in claims 1 or 2 in which the heat conductive elements are perforated at a central area and include an imperforate perimeter.

4. A device as claimed in claim 1 in which the heat-conductive elements and spacers are arranged cylindrically about an axis and in which at least a portion of the flow path is radial from its axis.

* * * * *